US006959966B2

(12) United States Patent
Kristen

(10) Patent No.: US 6,959,966 B2
(45) Date of Patent: Nov. 1, 2005

(54) CHAIR WITH SWING-OUT FOOTREST

(75) Inventor: Martin Kristen, Gelsenkirchen (DE)

(73) Assignee: Stanzwerk Wetter Sichelschmidt GmbH & Co. KG, Wetter (DE)

( * ) Notice: Subject to any disclaimer, the term of this patent is extended or adjusted under 35 U.S.C. 154(b) by 0 days.

(21) Appl. No.: 10/848,832

(22) Filed: May 18, 2004

(65) Prior Publication Data

US 2004/0232741 A1 Nov. 25, 2004

(30) Foreign Application Priority Data

May 19, 2003 (DE) ..... 103 22 795
Dec. 10, 2003 (DE) ..... 203 19 123 U

(51) Int. Cl.[7] ..... A47C 20/00
(52) U.S. Cl. ..... 297/423.26
(58) Field of Search ..... 297/69, 68, 423.1, 297/423.19, 423.26, 423.28

(56) References Cited

U.S. PATENT DOCUMENTS 24,511 A * 6/1859 Wagner et al. ..... 297/69
27,645 A * 3/1860 McGregor ..... 297/68
513,169 A * 1/1894 Armstrong ..... 297/69
2,834,397 A * 5/1958 Kluglein et al. ..... 297/68
3,873,152 A * 3/1975 Garas ..... 297/68
4,678,229 A * 7/1987 Ryan et al. ..... 297/68
6,454,353 B1 * 9/2002 Knaus ..... 297/284.11

* cited by examiner

*Primary Examiner*—Milton Nelson, Jr.
(74) *Attorney, Agent, or Firm*—Hebert Dubno; Andrew Wilford

(57) ABSTRACT

A chair has a frame, a main link having an inner end pivoted on the frame about an inner axis fixed relative to the frame and an outer end defining an outer axis parallel to the inner axis. An outer arm has an inner end pivoted at the outer axis on the outer axis of the main link and an outer end carrying a footrest. An inner wheel is fixed nonrotatably on the frame at the inner axis, and an outer wheel is fixed nonrotatably on the inner end of the outer arm at the outer axis. A chain, belt, or the like connected to both of the wheels couples same together for joint synchronous rotation. A drive can pivot the main link about the inner axis and thereby pivot the outer arm about the outer axis.

11 Claims, 3 Drawing Sheets

CHAIR WITH SWING-OUT FOOTREST

FIELD OF THE INVENTION

The present invention relates to a chair. More particularly this invention concerns a chair with a swing-out footrest.

BACKGROUND OF THE INVENTION

A recliner chair has a footrest that can move between a retracted position extending vertically and tucked underneath a front edge of the seat cushion and an extended position extending horizontally and positioned in front of and generally level with the seat cushion. The footrest moves into the extended position as other elements of the chair's mechanism tilt the chairs backrest rearwardly and normally also lower a rear end of the seat cushion or raise its front end.

The standard mechanism for shifting the footrest is formed by a pair of horizontally spaced scissor linkages having unequal legs to effect the arcuate and twisting movement of the footrest. These linkages have to be identical and function identically to ensure smooth movement of the footrest.

Not only are these scissor linkages fairly complex so that they add considerably to the cost of the chair, but they present a real danger of pinching the user or the user's clothing. It is critical to keep anything delicate out of contact with the scissor link-ages since they can damage or, at the very least, dirty anything that touches or gets tangled in them.

OBJECTS OF THE INVENTION

It is therefore an object of the present invention to provide an improved recliner chair with a swing-out footrest.

Another object is the provision of such an improved recliner chair with a swing-out footrest which overcomes the above-given disadvantages, that is whose footrest-operating mechanism is simple, inexpensive, and safe.

SUMMARY OF THE INVENTION

A chair has according to the invention a frame, a main link having an inner end pivoted on the frame about an inner axis fixed relative to the frame and an outer end defining an outer axis parallel to the inner axis. An outer arm has an inner end pivoted at the outer axis on the outer axis of the main link and an outer end carrying a footrest. An inner wheel is fixed nonrotatably on the frame at the inner axis, and an outer wheel is fixed nonrotatably on the inner end of the outer arm at the outer axis. A chain, belt, or the like connected to both of the wheels couples same together for joint synchronous rotation. A drive can pivot the main link about the inner axis and thereby pivot the outer arm about the outer axis.

With this system the mechanism can, according to another feature of the invention, be restricted to a region lying on a generally symmetrical central symmetry plane of the chair. Thus the main link lies on the plane so that it is largely out of the way of the user, and does not need to be made in two identical arrangements as the main link can be robust enough to support the foot rest.

According to the invention, the arm is comprised of a pair of parallel arm elements offset from and symmetrically flanking the plane, but still lying fairly close to the plane and well inward out of the outer bounds of the chair. A shaft on the outer axis is fixed to the outer wheel and has ends projecting from the link outer end and fixed in the arm elements. Respective shield tubes fixed to the main link coaxially surround the shaft ends between the main link and the arm elements.

In addition in accordance with the invention the main link is formed by a pair of confronting shells extending between the inner and outer axes and forming a cavity holding the wheels and the connecter between them. This main link further has a bracket fixed between the inner and outer axes to the shells. The drive is connected to the bracket. Thus all the moving parts for the foot rest are enclosed so that they cannot pinch or dirty the user of the chair.

The drive includes an extensible actuator having one end pivoted on the frame and an opposite end operatively engaged with the main link between the axes. A drive link is pivoted on the opposite end of the actuator and on the main link between the inner and outer axes. Furthermore a control arm has an end pivoted on the frame and another arm pivoted at the opposite end of the actuator. This control arm forces the point at which it, the actuator, and the drive link are pivoted together to move in an arc.

According to a further feature of the invention, a shaft extends along the inner axis. The main link is fixed at its inner end to the shaft, and a pair of axially spaced arms is fixed to the frame and rotatably carries the shaft. The inner wheel is fixed to one of the pair of arms.

To prevent a person from being injured when the footrest is retracted, the footrest cushion is mounted via a releasable coupling to the outer end of the main link.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
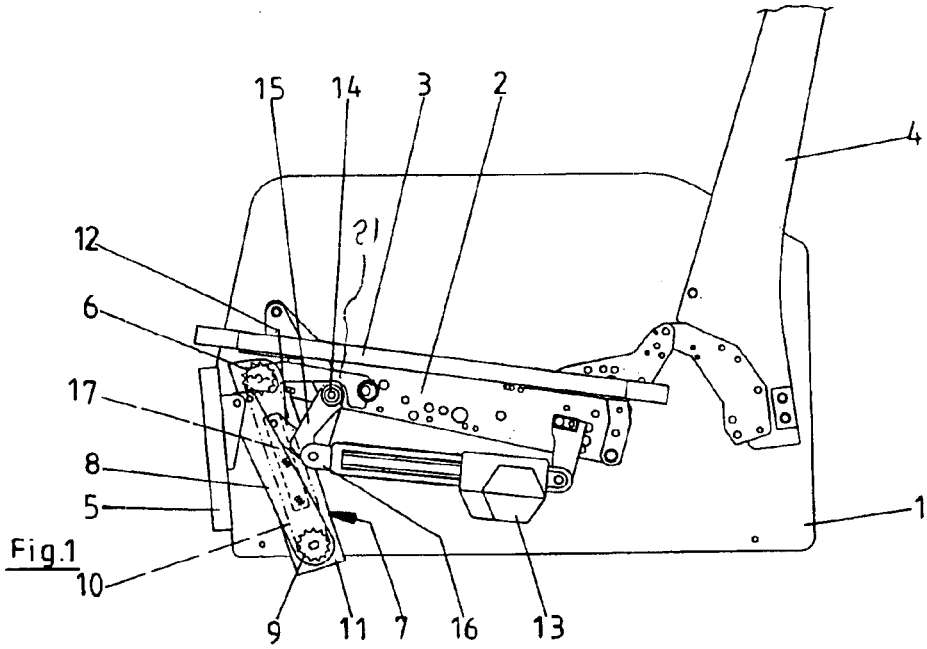
FIGS. 1, 2, and 3 are side sectional views showing the mechanism of the chair according to the invention in retracted, partially extended, and fully extended positions, the upholstered parts of the chair being omitted for clarity of view.
Figure 2:
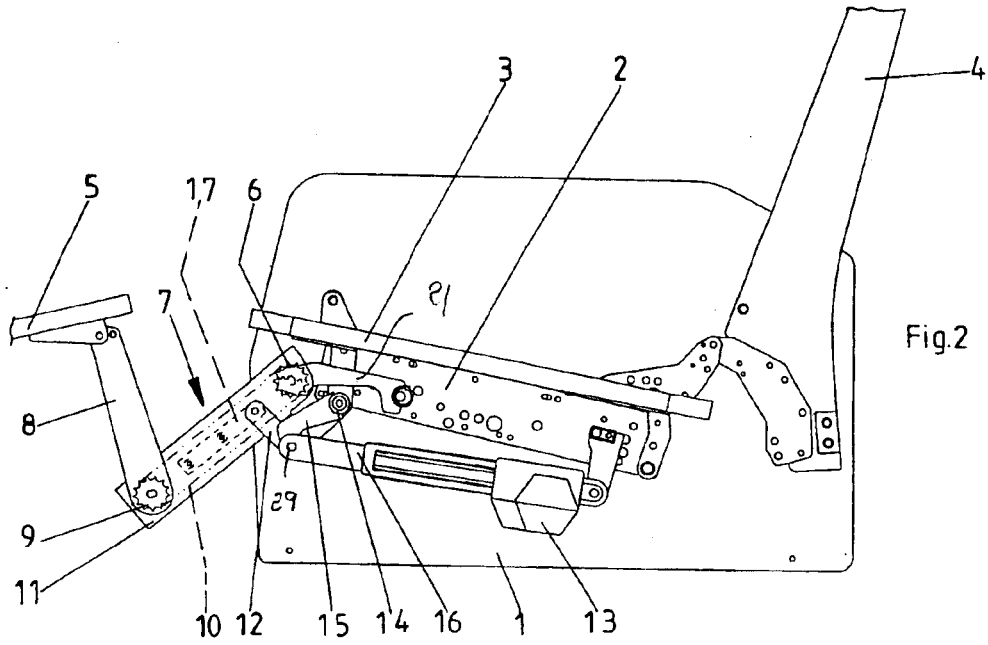
Figure 3:
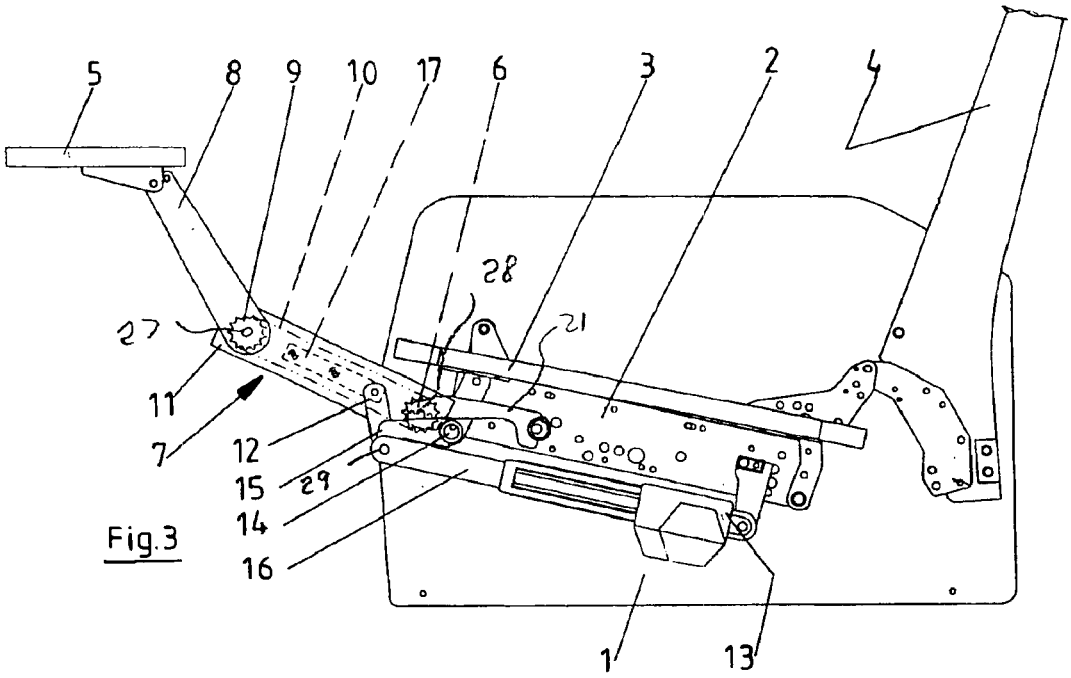
Figure 4:
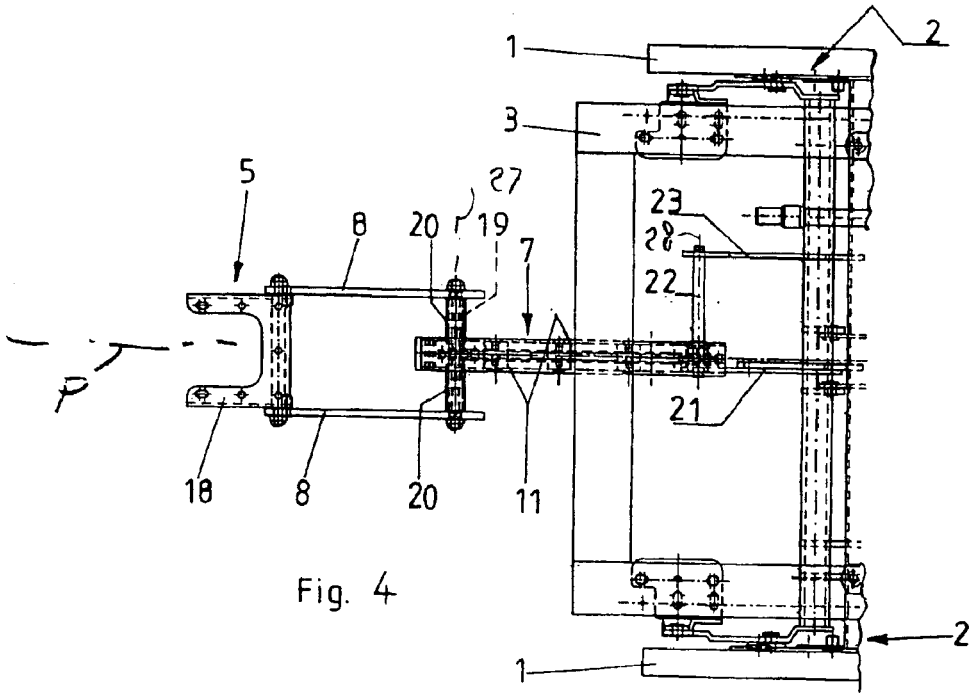
FIG. 4 is a top view of the foot-rest mechanism in the fully-extended position.
Figure 6:
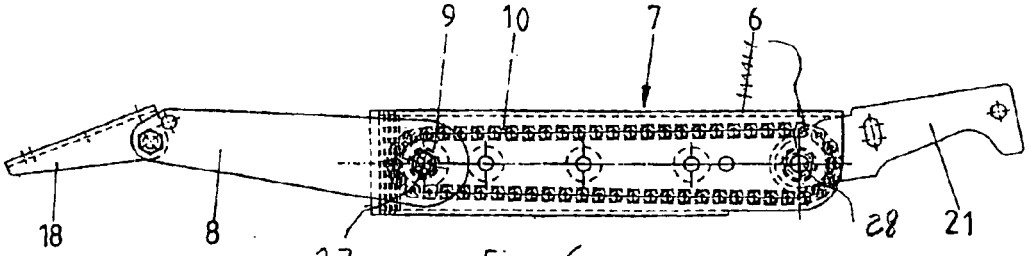
FIG. 5 and 6 are side and top views of the mechanism shown in FIG. 4.
Figure 5:
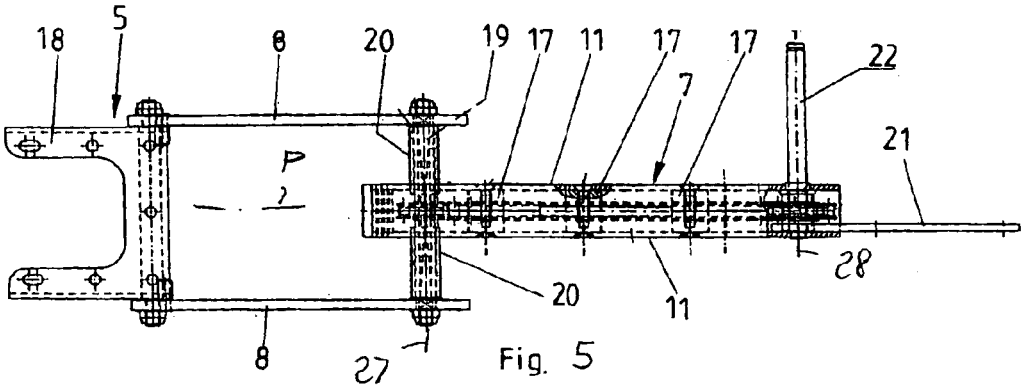

As seen in FIGS. 1 to 5, a chair according to the invention has a stationary frame or base 1 generally symmetrical to a central vertical plane P and having a pair of side base plates 2 symmetrically flanking the plane P below a seat plate 3. A back 4 projects upward from a rear end of the seat plate 3. The seat plate 3 and back 4 can also move, but their movements are not relevant to the instant invention.

A footrest 5 is carried on a mounting plate 18 at an outer end of a pair of arms 8 that symmetrically flank the plane P and that have inner ends pivoted about an outer axis 27 of a rigid arm 7 lying on the plane P and having an inner end fixed at an inner axis 28 on a shaft 22 pivoted on arms 21 and 23 fixed to the frame 1. A gear wheel 6 centered on the inner axis 28 is fixed nonrotatably on the frame 1 and an identical outer gear 9 is rotatable about the outer axis 27 at the outer end of the link 7. The gear 9 is fixed to a shaft 19 projecting in both directions along the axis 27 from the link 7 and having outer ends fixed to the inner ends of the arms 8. A chain 10 is engaged over the gear wheels 6 and 9 so that they are coupled together for joint synchronous rotation. Instead of the chain 10 and gears 6 and 9, it would be possible to use a toothed belt and pulleys. Alternately a gear train could replace the chain 10. One or two spring-loaded cables spanned over two wheels could also be used to hold the outer wheel 9 in the same angular position relative to the inner wheel 6 regardless of the angular position of the link 7.

This link 7 is actually formed by two elongated shells 11 open toward each other and flanking a central bracket 17 securing them together and lying between the reaches of the chain 10. This prevents the user of the chair from direct contact with the gears 6 and 9 and the chain 10. Similarly a pair of tubes 20 fixed to the outer end of the link 7 coaxially surround the shaft 10 between the link 7 and the arms 8 to prevent contact with this shaft 19.

An actuator 13 that can be powered electrically, hydraulically, or pneumatically has an output element 16 pivoted to an inner end of a link 12 whose outer end is pivoted at an axis 29 to the link 7 at the bracket 17 between the axes 27 and 28. A crank arm 15 has an inner end pivoted at 14 on the base 1 and an outer end pivoted at 29 on the element 16 and link 12 to force this axis 29 to move along an arcuate path as the element 16 moves out (to the left in FIGS. 1 to 3) and in (to the right in FIGS. 1 to 3).

Figure 7:
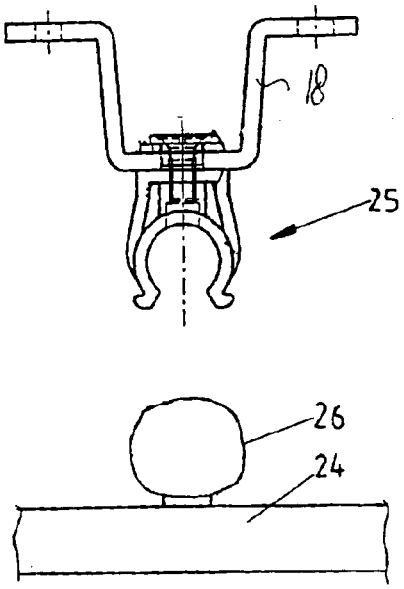
FIG. 7 is a view of a detail of the foot rest.

FIG. 7 shows how an upholstered footrest cushion 24 is provided with a pair of mounting rods 26 (only one shown) that fit in clips 25 carried on the footrest support 18. Thus if a user's leg gets caught between the footrest cushion 24 and the base 1 when the footrest 5 is being lowered, the cushion 24 will disconnect from the support 18 and not injure the user.

I claim:

1. A chair comprising:

a frame generally symmetrical to a central upright plane;

a main link lying generally on the plane and having an inner end pivoted on the frame about an inner axis fixed relative to the frame and an outer end defining an outer axis parallel to the inner axis;

an outer arm having an inner end pivoted at the outer axis on the outer end of the main link and having an outer end;

a foot rest on the outer-arm outer end;

an inner wheel fixed on the frame at the inner axis;

an outer wheel fixed on the inner end of the outer arm at the outer axis and pivotal with the outer arm about the outer axis through a plurality of angular positions;

connecting means connected to both of the wheels for holding the outer wheel in the same angular position relative to the inner wheel regardless of the angular position of the main link; and drive means for pivoting the main link about the inner axis and thereby pivoting the outer arm about the outer axis.

2. The chair defined in claim 1, further comprising a shaft extending along the inner axis, the main link being fixed at its inner end to the shaft; and a pair of axially spaced arms fixed to the frame and rotatably carrying the shaft, the inner wheel being fixed to one of the pair of arms.

3. The chair defined in claim 1 wherein the arm is comprised of a pair of parallel arm elements offset from and symmetrically flanking the plane.

4. The chair defined in claim 3, further comprising a shaft on the outer axis fixed to the outer wheel and having ends projecting from the link outer end and fixed in the arm elements.

5. The chair defined in claim 4, further comprising respective shield tubes fixed to the main link and coaxially surrounding the shaft ends between the main link and the arm elements.

6. The chair defined in claim 1 wherein the maim link is formed by a pair of confronting shells extending between the inner and outer axes and forming a cavity holding the wheels and the connecting means.

7. The chair defined in claim 6 wherein the main link further has a bracket fixed between the inner and outer axes to the shells, the drive means being connected to the bracket.

8. A chair comprising:

a frame;

a main link having an inner end pivoted on the frame about an inner axis fixed relative to the frame and an outer end defining an outer axis parallel to the inner axis;

an outer arm having an inner end pivoted at the outer axis on the outer end of the main link and having an outer end;

a foot rest on the outer-arm outer end;

an inner wheel fixed on the frame at the inner axis;

an outer wheel fixed on the inner end of the outer arm at the outer axis and pivotal with the outer arm about the outer axis through a plurality of angular positions;

connecting means connected to both of the wheels for holding the outer wheel in the same angular position relative to the inner wheel regardless of the angular position of the main link; and drive means including an extensible actuator having one end pivoted on the frame and an opposite end operatively engaged with the main link between the axes for pivoting the main link about the inner axis and thereby pivoting the outer arm about the outer axis.

9. The chair defined in claim 8, further comprising a drive link pivoted on the opposite end of the actuator and on the main link between the inner and outer axes.

10. The chair defined in claim 9, further comprising a control arm having an end pivoted on the frame and another arm pivoted at the opposite end of the actuator.

11. A chair comprising:

a frame;

a main link having an inner end pivoted on the frame about an inner axis fixed relative to the frame and an outer end defining an outer axis parallel to the inner axis;

an outer arm having an inner end pivoted at the outer axis on the outer end of the main link and having an outer end;

a foot rest on the outer-arm outer end;

an inner wheel fixed on the frame at the inner axis;

an outer wheel fixed on the inner end of the outer arm at the outer axis and pivotal with the outer arm about the outer axis through a plurality of angular positions;

connecting means connected to both of the wheels for holding the outer wheel in the same angular position relative to the inner wheel regardless of the angular position of the main link;

drive means for pivoting the main link about the inner axis and thereby pivoting the outer arm about the outer axis;

a footrest cushion; and a releasable coupling securing the cushion to the outer end of the arm.

* * * * *